US005889359A

United States Patent [19]

Seko

[11] Patent Number: 5,889,359

[45] Date of Patent: Mar. 30, 1999

[54] FIELD-EMISSION TYPE COLD CATHODE WITH ENHANCED ELECTRON BEAM AXIS SYMMETRY

[75] Inventor: Nobuya Seko, Tokyo, Japan

[73] Assignee: NEC Corporation, Japan

[21] Appl. No.: 781,961

[22] Filed: Dec. 20, 1996

[30] Foreign Application Priority Data

Dec. 27, 1995 [JP] Japan ..... 7-341532

[51] Int. Cl.[6] ..... H01J 1/02; H01J 1/30

[52] U.S. Cl. ..... 313/309; 313/308; 313/336; 313/351; 313/497; 313/331

[58] Field of Search ..... 313/308, 309, 313/306, 336, 351, 497, 331, 332, 495; 315/169.4

[56] References Cited

U.S. PATENT DOCUMENTS 5,734,223 3/1998 Makishima et al. ..... 313/495

FOREIGN PATENT DOCUMENTS 714501 1/1995 Japan .

OTHER PUBLICATIONS

Spindt; "A Thin Film Field–Emission Cathode"; Jun. 1968; pp. 3504–3505; J. Applied Physics, Vol. 39, No. 7.

Dawson et al; "Beam Focusing for Field–Emission Flat–Panel Displays ";Feb. 1995; pp.340–347; IEEE Transactions on Electron Devices vol.42; No. 2.

Py et al; "Microtip electron Beam Refocusing by Surrounding Ring"; 1995; p. 640, 30p–T–3; 42nd Applied Physics Related Association Conference.

*Primary Examiner*—Jay M. Patidar

*Attorney, Agent, or Firm*—Hayes, Soloway, Hennessey, Grossman & Hage, P.C.

[57] ABSTRACT

There is provided a field-emission type cold cathode including (a) a substrate at least a surface of which has electrical conductivity, (b) an insulating layer formed on the substrate, (c) an electrically conductive gate electrode formed on the insulating layer, (d) an almost conical, sharp-pointed emitter electrode disposed in a hole formed through the gate electrode and insulating layer, (e) a focusing electrode formed on the insulating layer so that the focusing electrode is located in the same plane as the gate electrode and surrounds the gate electrode, and (f) a feeder line formed in the same plane as the gate electrode. The feeder line extends from the gate electrode into the focusing electrode and being shaped complementarily with the focusing electrode so that the focusing electrode is present at every radial directions as viewed from a center of the emitter electrode. The present invention provides an electron source which has small divergence and has high axis-symmetry, and which can be fabricated by conventional field-emission type cold cathode fabrication methods having no focusing electrodes. Hence, the present invention makes it possible to provide a high-quality cathode at lower cost suitable for an electron source for an electronic tube and an electron beam emitter.

15 Claims, 10 Drawing Sheets

FIELD-EMISSION TYPE COLD CATHODE WITH ENHANCED ELECTRON BEAM AXIS SYMMETRY

BACKGROUND OF THE INVENTION

1. Field of the Invention

The present invention relates to a field-emission type cold cathode, and more particularly to an improvement in a field-emission type cold cathode to thereby make a divergence angle of emitted electron beams smaller and enhance symmetry about an axis along which electron beams are emitted.

2. Description of the Related Art

Field-emission type cold cathode have been developed as an electron source substituted for a hot cathode utilizing thermionic emission. A field-emission type cold cathode includes two electrodes one of which has a pointed end. Between the electrodes is generated a high electric field having intensity ranging from $2\times10^7$V/cm to $5\times10^7$V/cm or greater to thereby emit electrons into the atmosphere. Accordingly, the performance of a device including a field-emission type cold cathode is dependent on the sharpness of a pointed end. In general, it is necessary for a field-emission type cold cathode to have a pointed end having a radius of curvature equal to or smaller than several hundred angstroms. In addition, in order to generate an electric field, the two electrodes have to be spaced from each other by 1 $\mu$m or smaller, and a voltage ranging from tens to hundreds of volts has to be applied across the two electrodes.

In practical use, thousands of to tens-of-thousand of the above mentioned cathodes are formed in a substrate in the form an array. Thus, field-emission type cold cathodes are generally manufactured by means of the technology for fabricating a semiconductor device having fine circuit patterns.

An example of the above mentioned field-emission type cold cathode has been suggested by C. A. Spindt: "A Thin-Film Field-Emission Cathode", J. Applied Physics, Vol. 39, No. 7, June 1968, pp. 3504–3505. According to Spindt, a pointed end of a field-emission type cathode is formed by depositing refractory metal such as molybdenum on an electrically conductive substrate.

FIG. 1 illustrates a structure of a field-emission type cathode suggested by Spindt. There is formed an insulating layer 34 on an electrically conductive substrate 35, and the insulating layer 34 is covered with an electrically conductive gate electrode 32. There is formed a hole 36 having a diameter of about 1 $\mu$m, passing through the gate electrode 32 and the insulating layer 34 and terminating at the substrate 35. In the hole 36 is disposed an emitter electrode 31 so that the emitter electrode 31 is in electrical connection with the substrate 35 and further so that a pointed end of the emitter electrode 31 is located close to an inner edge of the gate electrode 32.

An anode electrode 11 is disposed facing the emitter electrode 31. The anode electrode 11 consists of a glass substrate 12, an electrically conductive, transparent film 13 formed on the glass substrate 12, and a thin fluorescent film 14 formed on the transparent film 13. A power supply 37 is disposed between the electrically conductive, transparent film 13 and the substrate 35, and also between the gate electrode 32 and the substrate 35.

By applying a positive voltage to both the transparent film 13 and the gate electrode 32 and a negative voltage to the substrate 35 and hence the emitter electrode 31, electron beams 15 are emitted from a pointed end of the emitter electrode 31. The illustrated cathode is called a vertical type field-emission cold cathode.

A field-emission type cathode as mentioned above may be used as an electron source for a planar display, a micro vacuum tube, electronic tubes such as a microwave tube and a cathode ray tube (CRT), and various sensors.

Electrons emitted from a pointed end of the emitter electrode 31 not only forward perpendicular to the substrate 35, but also extend in the vicinity of the emitter electrode 31 with a divergence half angle ranging from about 20° to about 30°. Thus, there is obtained a larger emission area than desired in a device having a fluorescent film to be excited by electron beams. When the illustrated field-emission type cathode is to be used as an electron source for an electronic tube, the extension of emission in the vicinity of the emitter electrode 31 would exert a degrading influence on beam-focusing carried out by electronic lenses.

One of solution to these problems is to provide an additional focusing electrode(s) to a device to thereby make a divergence angle smaller, as suggested by W. Dawson Kesling et al.: "Beam Focusing for Field-Emission Flat-Panel Displays", IEEE Transactions on Electron Devices, Vol. 42, No. 2, February 1995, pp. 340–347. This solution is grouped into two types.

One type includes, as illustrated in FIG. 2, a substrate 5 and a multi-layered structure having a first insulating layer 4, a gate electrode 2, a second insulating layer 4*a* and a focusing electrode 3 deposited on the substrate 5 in this order. There is formed a hole 36*a* passing through the focusing electrode 3, the second insulating layer 4*a*, the gate electrode 2 and the first insulating layer 4 and terminating at the substrate 5. In the hole 36*a* is disposed a conical emitter electrode 1 having a pointed end. By applying a lower voltage to the focusing electrode 3 than that of the gate electrode 2, electron beams are focused by an electric field generated by the focusing electrode 3. For instance, provided that the emitter electrode 1 is kept at 0 V, 70 V is applied to the gate electrode 2 and 10 V is applied to the focusing electrode 3.

The other type includes, as illustrated in FIG. 3, a substrate 5, an insulating layer 4 formed on the substrate 5, an annular-shaped gate electrode 2 formed on the insulating layer 4, and a focusing electrode 3 formed on the insulating layer 4 and at the same plane as the gate electrode 2 and surrounding the gate electrode 2. There is formed a hole 36*b* passing through the gate electrode 2 and the first insulating layer 4 and terminating at the substrate 5. In the hole 36*b* is disposed a conical emitter electrode 1 having a pointed end. By applying a lower voltage to the focusing electrode 3 than that of the emitter electrode 1, electron beams are focused by an electric field generated by the focusing electrode 3. For instance, provided that the emitter electrode 1 is kept at 0 V, 70 V is applied to the gate electrode 2 and −20 V is applied to the focusing electrode 3.

If the field-emission type cold cathode as illustrated in FIG. 2 is used, in order to make a divergence angle of electron beams emitted from the emitter electrode 1 smaller, an additional step is carried out for forming the second insulating layer 4*a* and the focusing electrode 3. In addition, since it is necessary to form a feeder line extending from the gate electrode 2 and the focusing electrode 3 (for supplying power thereto) with the feeder line being electrically insulated therefrom, it is not avoidable to involve complex photolithography and etching steps for the formation of wiring pattern.

If the hole 36*a* in which the emitter electrode 1 is disposed is formed by single photolithography, it is necessary to provide an etching depth almost twice as long compared with an etching depth for a field-emission type cathode having no focusing electrodes. Thus, it is difficult in dry etching to properly determine a selection ratio of an etching depth to a photoresist layer (acting as a mask). In addition, it is difficult in wet etching to control side etching. If the focusing electrode 3 and the gate electrode 2 are to be separately patterned by carrying out photolithography twice, the above mentioned problems can be overcome. However, another problem arises that it is quite difficult or almost impossible to eliminate misregistration between the two patterns, and thus, such misregistration would exert a degrading influence on the symmetry of focusing effects.

In the field-emission type cold cathode as illustrated in FIG. 3, the focusing electrode 3 can be formed by patterning simultaneously with the gate electrode 2. Accordingly, the problems which occur in the cathode illustrated in FIG. 2 do not arise.

However, the field-emission type cold cathode illustrated in FIG. 3 has another problem. FIG. 4A illustrates a field-emission type cold cathode having been suggested in Japanese Unexamined Patent Publication No. 7-14501. The illustrated cold cathode is comprised of a circular-shaped gate electrode 2, a plurality of emitter electrodes 1 each disposed in a hole formed with the gate electrode 2, an annular-shaped focusing electrode 3 surrounding the gate electrode 2, and two focusing pads 7, 8 formed outside the gate electrode 2 and the focusing electrode 3. As illustrated, the gate electrode 2 is connected to the gate pad 7 through a feeder line 9, and the focusing pad 8 is connected to the focusing electrode 3 through a feeder line 9*a*.

In the illustrated cold cathode of FIG. 4A, if the feeder line 9 is to be formed at the same plane as the gate electrode 2 and the focusing electrode 3, the focusing electrode 3 is partially cut in order to draw the feeder line 9 from the gate electrode 2 (located inside the focusing electrode 3) to the gate pad 7 located outside the focusing electrode 3. By partially cutting the focusing electrode 3, the focusing electrode 3 is no longer present in a direction in which the feeder line 9 extends. Hence, asymmetry would arise in an electric field generated by a voltage applied to the focusing electrode 3, resulting in electrons being attracted to the voltage of the feeder line 9. As a result, electron beams spread towards the direction in which the feeder line 9 extends.

For instance, in such a device as illustrated in FIG. 1 where the fluorescent film 14 formed over the anode electrode 11 is to be excited by the electron beams 15, emission area 27 of the device spreads in a direction in which the focusing electrode 3 is partially cut, as illustrated in FIG. 4B. Namely, if the devices illustrated in FIG. 4A are arranged in a plane and used as a display device, there would arise problems that resolution is deteriorated and axis-symmetry of beams is also deteriorated when used as an electron beam source.

One of methods of drawing the feeder line 9 from the gate electrode 2 through the focusing electrode 3 in a device including the annular-shaped focusing electrode 3 surrounding the gate electrode 2, as illustrated in FIG. 3, is suggested by Christophe Py et al., "Microtip electron Beam Refocusing by Surrounding Ring", 42nd Applied Physics Related-Association Conference, 1995, 30p-T-5. FIG. 5A illustrates the suggested structure including a gate electrode 2, an emitter electrode 1 disposed in a hole formed with the gate electrode 2, a focusing electrode 3 almost surrounding the gate electrode 2, gate pads 7 located outside the focusing electrode 3, and a pair of feeder lines 9 extending from the gate electrode 2 to the gate pads 7. As illustrated, the feeder lines 9 extend symmetrically about the gate electrode 2 in left-right directions in which the focusing electrode 3 is partially cut.

FIG. 5B illustrates emission area 28 established on the fluorescent film 14 formed on the anode electrode 11 (see FIG. 1) by electron beams emitted from the emitter electrode 1 illustrated in FIG. 5A. Electron beams emitted from the emitter electrode 1 illustrated in FIG. 5A have a plane-symmetrical cross-section. However, the emission area 28 spreads along the directions in which the focusing electrode 3 is partially cut, and hence the focusing performance of the focusing electrode 3 is not improved.

As an alternative, as illustrated in FIG. 6, the focusing electrode 3 may be partially three-dimensionally formed above the feeder line 9 with an insulating layer 24 being filled between the focusing electrode 3 and the feeder line 9, to thereby avoid the focusing electrode 3 from being partially cut. However, there has to be carried out the increased number of steps of formation of the insulating layer 24 and of patterning, which would eliminate an advantage of avoiding the focusing electrode 3 from being partially cut.

As mentioned above, though the cathode illustrated in FIG. 3 having the annular-shaped focusing electrode 3 at the same plane as the gate electrode 2 provides an advantage of making it possible to simplify the fabrication process, it does have a problem that the feeder line 9 extending from the gate electrode 2 partially cuts the focusing electrode 2, resulting in that the performance of focusing electron beams is deteriorated and axis-symmetry of electron beams is also deteriorated.

SUMMARY OF THE INVENTION

In view of the foregoing problems, it is an object of the present invention to provide a field-emission type cold cathode capable of making electron beam divergence smaller, namely enhancing electron beam focusing performance, and further capable of keeping electron beam axis-symmetry.

There is provided a field-emission type cold cathode including (a) a substrate at least a surface of which has electrical conductivity, (b) an insulating layer formed on the substrate, (c) an electrically conductive gate electrode formed on the insulating layer, (d) an almost conical, sharp-pointed emitter electrode disposed in a hole formed through the gate electrode and insulating layer, (e) a focusing electrode formed on the insulating layer so that the focusing electrode is located in the same plane as the gate electrode and surrounds the gate electrode, and (f) a feeder line formed in the same plane as the gate electrode. The feeder line extends from the gate electrode into the focusing electrode and being shaped complementarily with the focusing electrode so that the focusing electrode is present at every radial direction around a center of the emitter electrode.

Advantageously complementariness in shape between the feeder line and the focusing electrode may be defined in any shape if it satisfies the above-mentioned condition. For instance, the complementariness can be comprised of linear segments. As an alternative, the complementariness may be comprised of curved-line segments. As another alternative, the complementariness may be comprised of a combination of linear and curved-line segments.

Specifically, the complementariness may include at least one C-shaped portion. The complementariness may be comprised of a combination of radially extending lines and circumferentially extending lines. As an alternative, the complementariness may include at least one line making an angle with a radius of the gate electrode.

The above mentioned field-emission type cold cathode may further include at least one compensation pattern formed with the gate electrode. The compensation pattern is disposed in rotational symmetry with a part of the feeder line.

For instance, the compensation pattern is shaped in such a way that it cooperates with the feeder line to form a windmill shape.

In accordance with the above mentioned present invention, though the focusing electrode is partially cut by the feeder line extending from the gate electrode through the focusing electrode, the focusing electrode is present around the emitter region in every radial directions, thereby ensuring axis-symmetry of an electric field for focusing electron beams.

Thus, the present invention provides an electron source which has small electron beam divergence and high axis-symmetry, and which can be fabricated by conventional field-emission type cold cathode fabricating methods having no focusing electrodes. Hence, the present invention makes it possible to provide a high-quality cathode at lower cost suitable for an electron source for an electronic tube and an electron beam emitter.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Figure 7A:
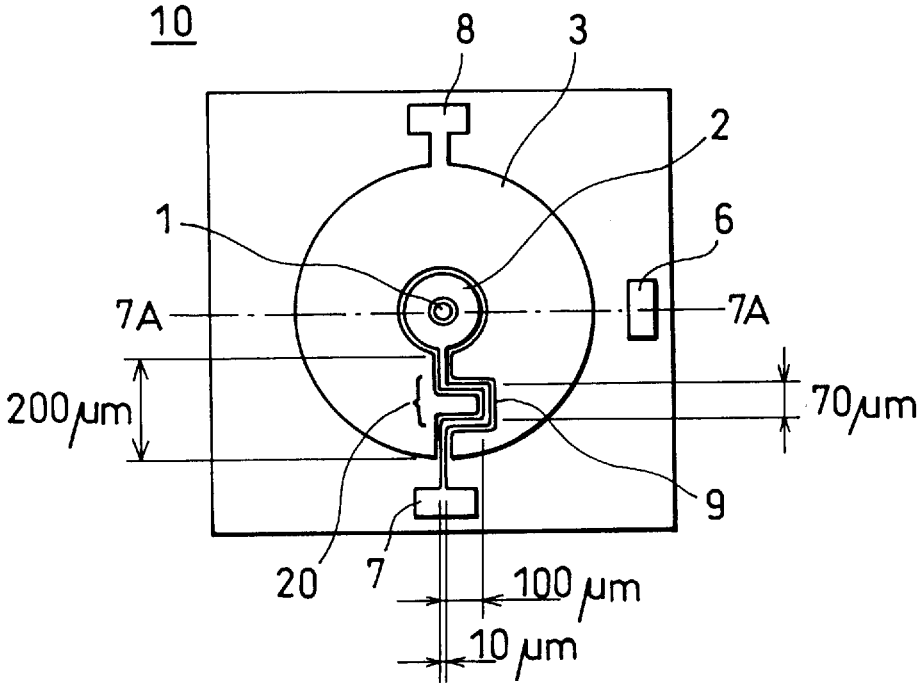
FIG. 7A is a plan view illustrating a field-emission type cold cathode made in accordance with the first embodiment of the present invention.
Figure 7B:
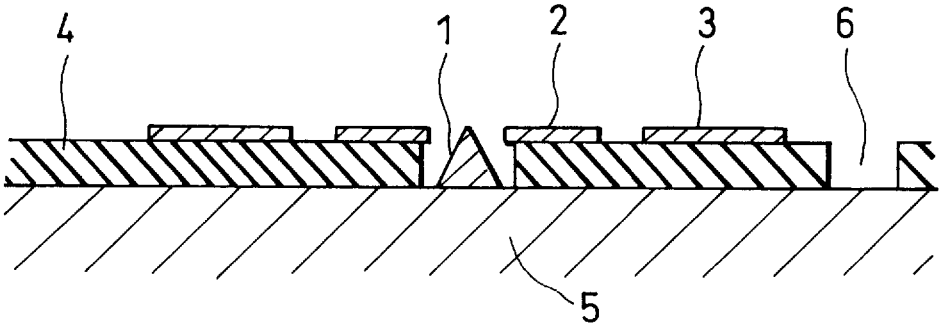
FIG. 7B is a partial cross-sectional view taken along the line 7A—7A in FIG. 7A.

With reference to FIGS. 7A and 7B illustrating a field-emission type cold cathode 10 made in accordance with the first embodiment of the present invention, a conical emitter electrode 1 having a pointed end is formed on an electrically conductive substrate 5. There is formed an insulating layer 4 around the emitter electrode 1, and an annular-shaped gate electrode 2 is formed on the insulating layer 4 so that the gate electrode 2 is disposed coaxially with the pointed end of the emitter electrode 1. A focusing electrode 3 formed on the insulating layer 4 is located at the same level as the gate electrode 2 and surrounds the gate electrode 2. Namely, the emitter electrode 1 is surrounded by both the gate electrode 2 and the focusing electrode 3. The emitter electrode 1 is connected to an exposed portion 6 of the substrate 5 situated at a surface or a bottom surface of the substrate 5, and connected to external circuits through the exposed portion 6. Similarly, the gate electrode 2 is connected to a gate pad 7 situated at a surface of the substrate 5 through a feeder line 9, and connected further to external circuits through the gate pad 7. The focusing electrode 3 is connected to external circuits through a focusing pad 8.

In a structure where the gate electrode 2 and the focusing electrode 3 are disposed coaxially with each other, the gate feeder line 9 extending from the gate electrode 2 has to pass through the focusing electrode 3 to reach the gate pad 7. To this end, the gate feeder line 9 is designed to be complementary in shape with the focusing electrode 3. In other words, the focusing electrode 3 is partially cut to form a groove (not referenced). Cutting edges of the focusing electrode 3 face complementarily with each other to thereby define a groove therebetween. The gate feeder line 9 extends just along the groove, and hence the gate feeder line 9 is also complementary in shape with the cutting edges of the focusing electrode 3. The complementariness between the gate feeder line 9 and the focusing electrode 3 ensures that the focusing electrode 3 is present at every radial directions around the emitter electrode 1.

For example, the gate feeder line 9 includes a C-shaped portion or almost square bent portion 20. The preferred of the focusing electrode 3 and the feeder line 9 are as follows.

Radially measured width of the focusing electrode 3 is 200 μm

Width of the gate feeder line 9 is 10 μm

Width of the square bent portion 20 in radial direction of the focusing electrode 3 is 70 μm Length of the square bent portion 20 in a direction perpendicular to the radial direction is 100 μm It should be noted that the gate feeder line 9 is depicted in larger scale than actual scale for better understanding of the first embodiment.

It is possible to form the field-emission type cold cathode illustrated in FIGS. 7A and 7B by conventional field-emission type cold cathode fabricating methods having no focusing electrode. That is, by merely changing a pattern of a photomask used for patterning a gate electrode on a gate layer formed over an insulating layer, the gate layer can be divided into the gate electrode 2 and the focusing electrode 3.

Figure 8A:
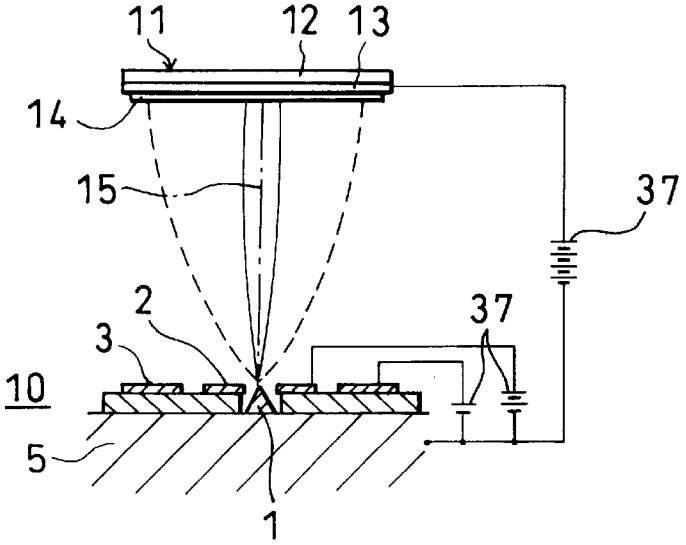
FIG. 8A is a cross-sectional view for showing the operation of the field-emission type cold cathode illustrated in FIG. 7A.

Hereinbelow is explained the operation of the field-emission type cold cathode illustrated in FIGS. 7A and 7B. With reference to FIG. 8A, an anode electrode 11 is disposed facing the field-emission type cold cathode 10. The anode electrode 11 consists of a glass substrate 12, an electrically conductive, transparent film 13 formed on the glass substrate 12, and a thin fluorescent film 14 formed on the transparent film 13. A power supply 37 is disposed between each of the electrically conductive, transparent film 13, the gate electrode 2 and the focusing electrode 3 and the substrate 5. By applying voltages to the transparent film 13, the gate electrode 2, the focusing electrode 3 and the substrate 5, electron beams are emitted from the pointed end of the emitter electrode 1 to thereby establish emission area on the fluorescent film 14. Specifically, assuming that the emitter electrode 1 is kept at 0 V, about 70 V is applied to the gate electrode 2, about (minus sign) 20 V (which is smaller than the voltage of the emitter electrode 1) is applied to the focusing electrode 3, and a voltage ranging from 100 V to 1000 V is applied to the anode electrode 11.

Figure 8B:
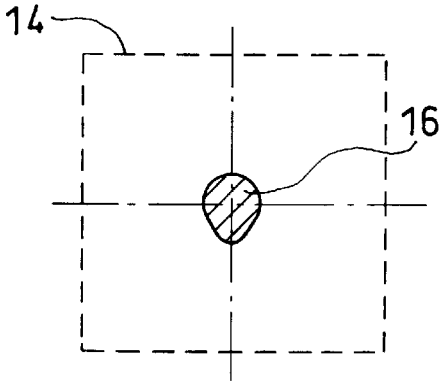
FIG. 8B shows emission area established when electron beams are emitted from an emitter electrode of the field-emission type cold cathode illustrated in FIG. 8A onto a fluorescent film.

FIG. 8B shows an emission area established by electron beams. The electron beams 15 are emitted from the pointed end of the emitter electrode 1 of the field-emission type cold cathode 10 illustrated in FIG. 8A by means of an electric field generated by the gate electrode 2, and focused by an electric field generated by the focusing electrode 3, to thereby establish the emission area 16 on the fluorescent film 14 of the anode electrode 11.

Figure 4A:
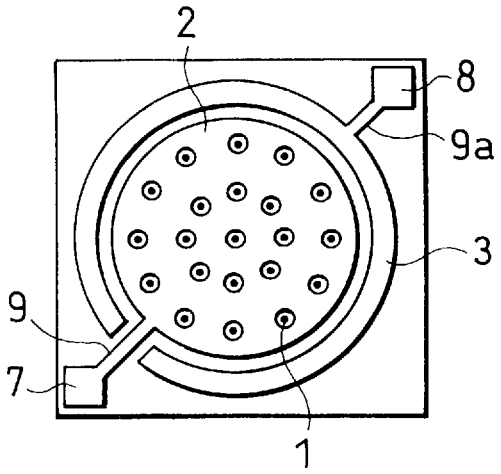
FIG.4A PRIOR ART
FIG. 4A is a plan view illustrating yet another conventional field-emission type cold cathode.
Figure 4B:
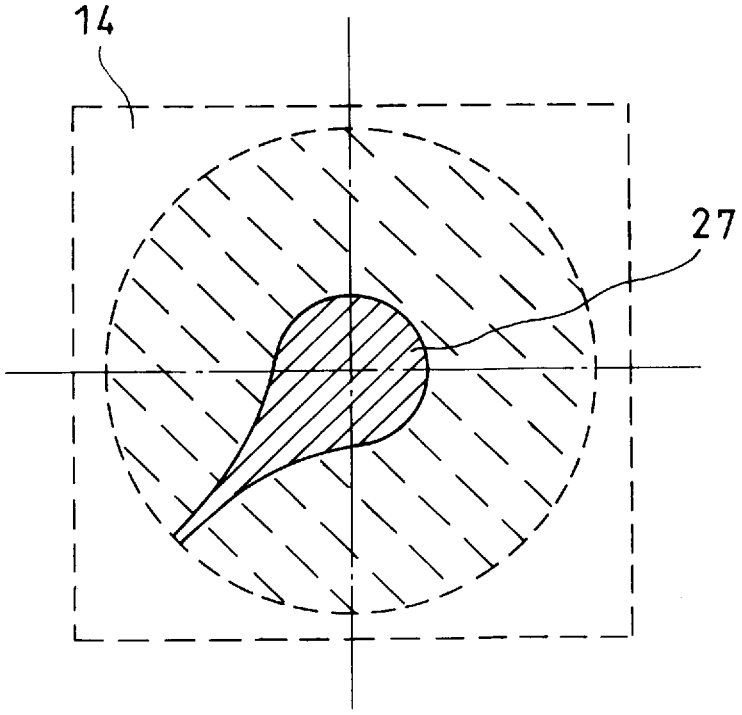
FIG.4B PRIOR ART
FIG. 4B shows emission area established when electron beams are emitted from an emitter electrode of the field-emission type cold cathode illustrated in FIG. 4A onto a fluorescent film.
Figure 5A:
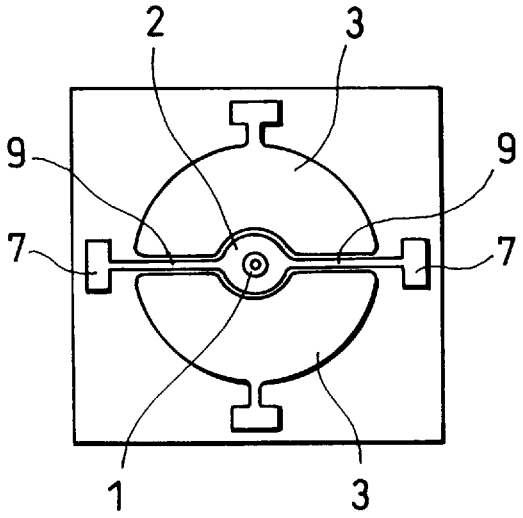
FIG.5A PRIOR ART
FIG. 5A is a plan view illustrating still yet another conventional field-emission type cold cathode.
Figure 5B:
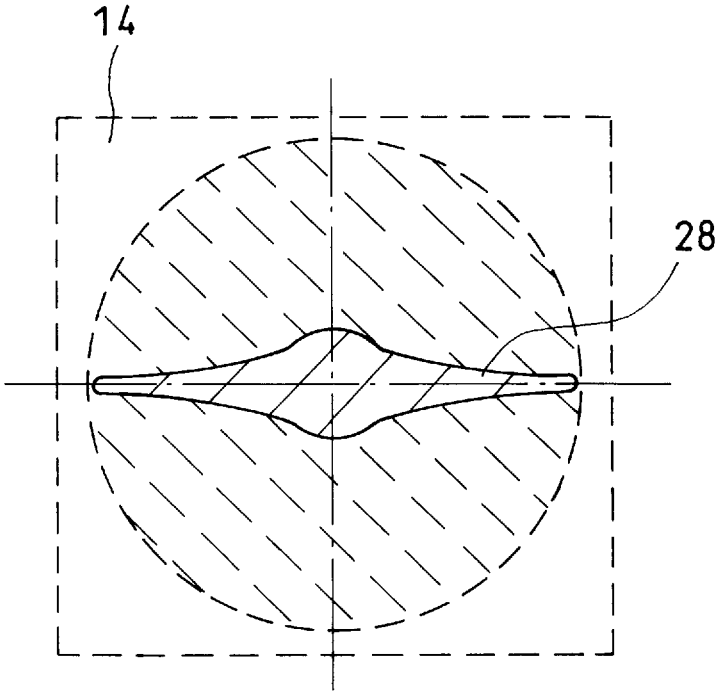
FIG.5B PRIOR ART
FIG. 5B shows emission area established when electron beams are emitted from an emitter electrode of the field-emission type cold cathode illustrated in FIG. 5A onto a fluorescent film.
Figure 9:
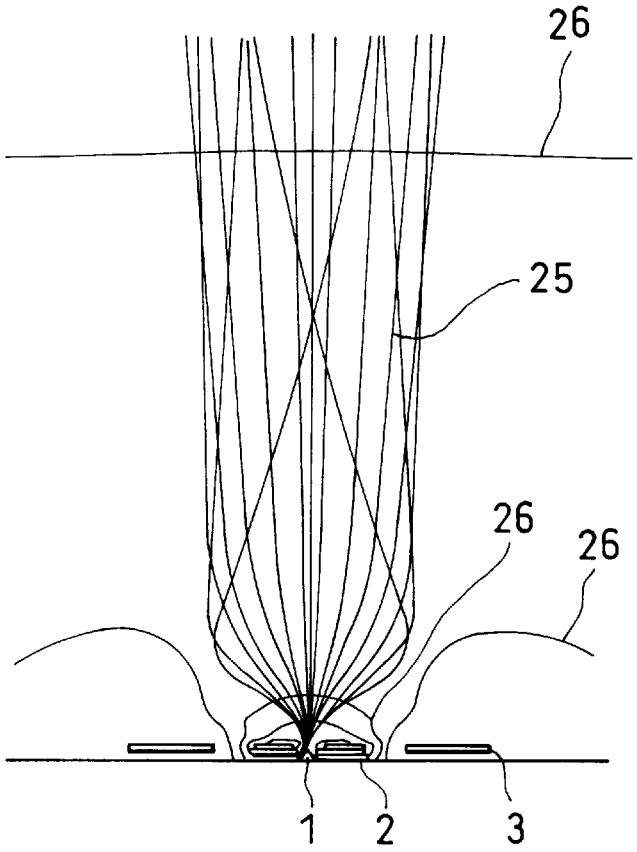
FIG. 9 shows the results of simulation for operation of a field-emission type cold cathode having a gate electrode and an annular-shaped focusing electrode surrounding the gate electrode.

FIG. 9 shows the results of two-dimensional simulation for the operation of a field-emission type cold cathode having the an annular-shaped focusing electrode 3 surrounding therein the gate electrode 2. When the cathode is operated under the following conditions:

voltage of the emitter electrode 1=0 V;

voltage of the gate electrode 2=70 V; and voltage of the focusing electrode 3=−20 V, there are obtained equipotential lines 26 and trajectory 25 of electron beams. Electrons emitted from the emitter electrode 1 first outwardly spread, but are immediately made to turn inwardly by a repulsive force generated by an electric field produced by the focusing electrode 3, and then focused. On the other hand, in a field-emission type cold cathode having a gate feeder line radially straight extending from an emitter electrode to a gate pad, a focusing electrode is absent in the plane passing through the emitter electrode, such as described above with reference to prior art FIG. 4B. Thus, an electric field for focusing electron beams is weakened in a direction in which such a plane extends. In addition, since a gate feeder line having the same potential as a gate electrode extends in the same direction, electron beams are attracted to the gate feeder line, resulting in that electron beams spread towards the gate feeder line.

Figure 8C:
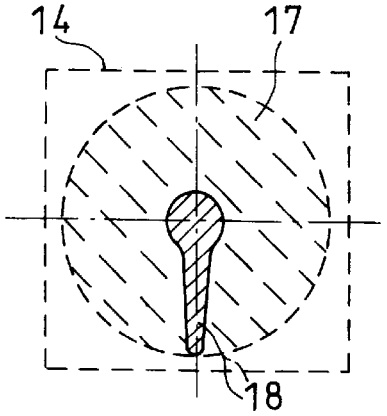
FIG. 8C is a figure for comparison with FIG. 8B, showing emission area established when electron beams are emitted from an emitter electrode of a conventional field-emission type cold cathode onto a fluorescent film.

As a result, as illustrated in FIG. 8C, an emission area 18 established by the above-mentioned cold cathode is rather focused than an emission area 17 established by a field-emission type cold cathode having no focusing electrode, but spreads in a direction in which the gate feeder line extends.

On the other hand, the field-emission type cold cathode made in accordance with the first embodiment has little asymmetry with respect to a shape of the focusing electrode 3 due to the presence of the gate feeder line 9, but makes it possible for the focusing electrode 3 to exist in all radial directions around the emitter electrode 1 to thereby accomplish superior focusing performance. As a result, as illustrated in FIG. 8B, the field-emission type cold cathode made in accordance with the first embodiment establishes the emission area 16 having high axis-symmetry on the fluorescent film 14.

Figure 1:
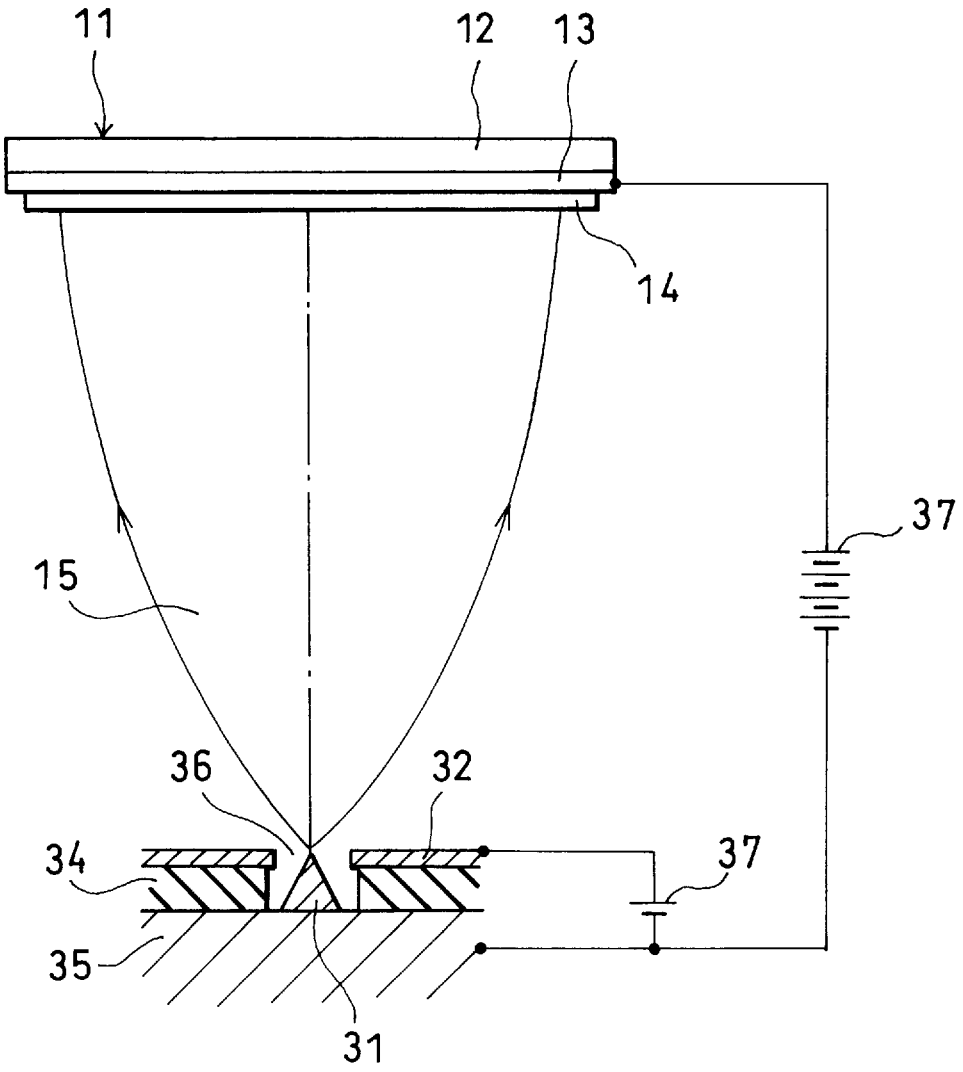
FIG.1 PRIOR ART
FIG. 1 is a partial cross-sectional view of a conventional field-emission type cold cathode.
Figure 2:
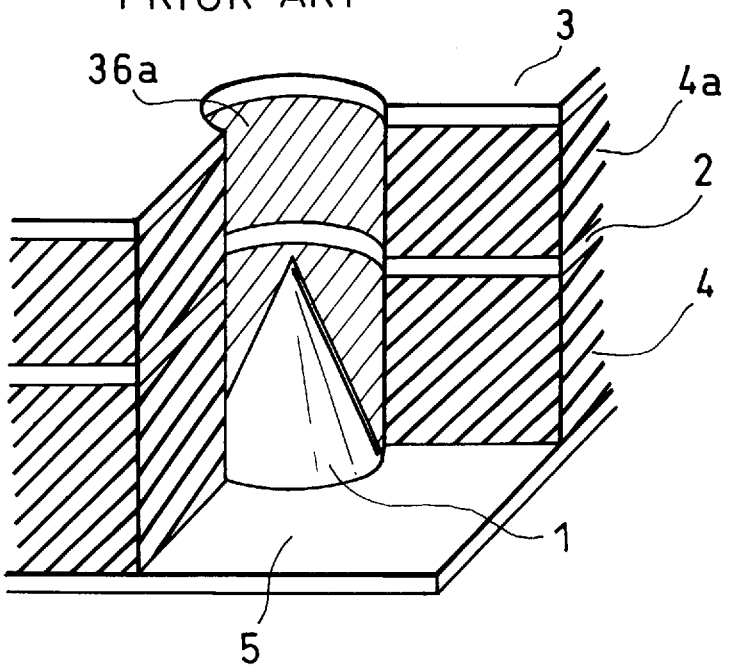
FIG. 2 PRIOR ART
FIG. 2 is a perspective view illustrating another conventional field-emission type cold cathode.
Figure 3:
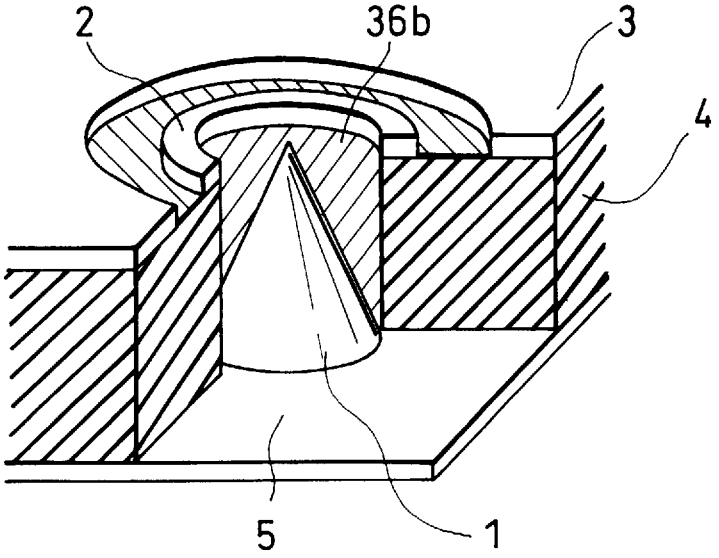
FIG. 3 PRIOR ART
FIG. 3 is a perspective view illustrating still another conventional field-emission type cold cathode.
Figure 6:
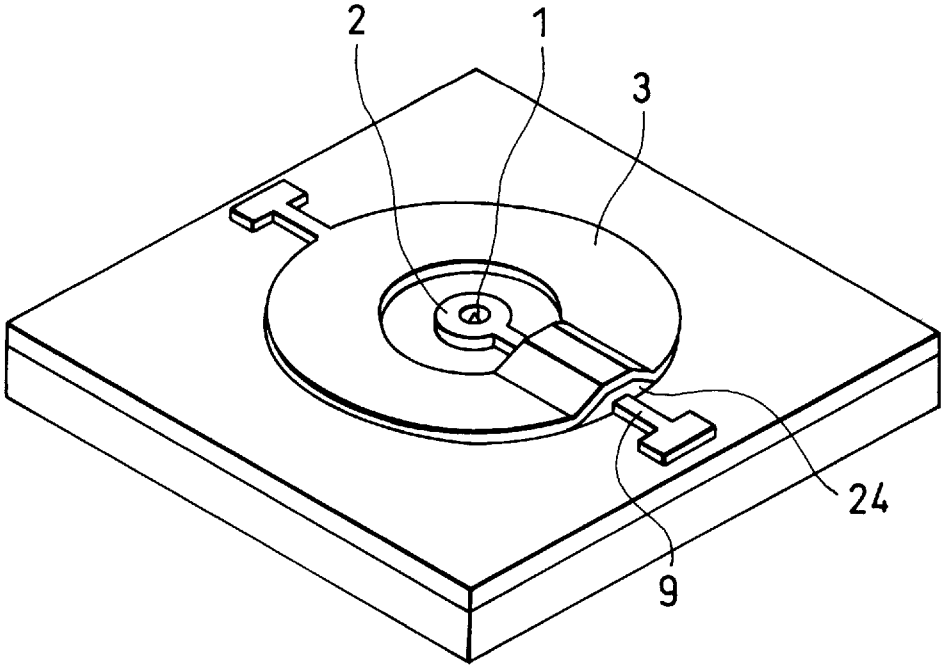
FIG.6 PRIOR ART
FIG. 6 is a perspective view illustrating further another conventional field-emission type cold cathode including a focusing electrode partially three-dimensionally formed above a feeder line.

In order to have highly axis-symmetrical electron beams, the focusing electrode 3 may be partially, three-dimensionally formed over the gate feeder line 9 so as not to partially cut the focusing electrode 3, as illustrated in FIG. 6, even in the field-emission type cold cathode illustrated in FIG. 3. However, the method of fabricating those cathodes becomes too complicated. Accordingly, the first embodiment is superior to those cathodes in that the present invention can be fabricated by a simpler method, and in addition, at lower costs.

In a display comprising a plurality of the cathodes illustrated in FIG. 8A, arranged in a plane in an array, the above mentioned focusing performance ensuring high axis-symmetry would accomplish high resolution. Hence, when the field-emission type cold cathode illustrated in FIG. 8A is incorporated in an electron gun, there is obtained high axis-symmetry of electron beams and high quality performance of focusing electron beams.

Figure 10:
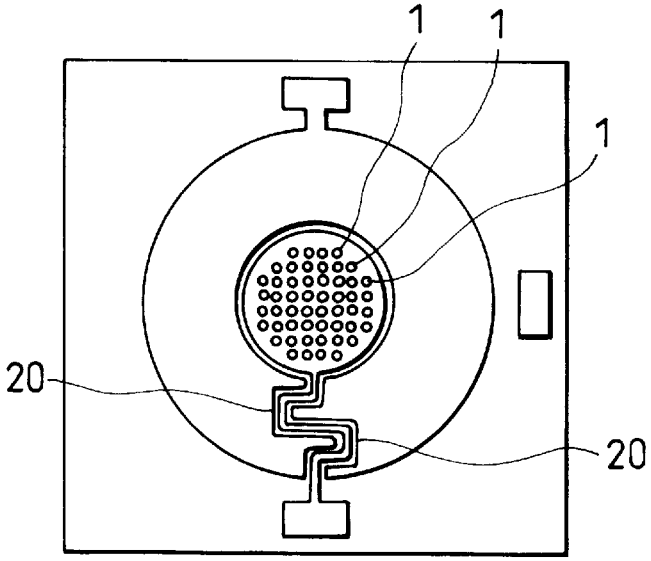
FIG. 10 is a plan view illustrating a variation of a field-emission type cold cathode made in accordance with the first embodiment.

Though the above-mentioned first embodiment includes only one emitter electrode 1, the number of the emitter electrodes is not to so limited to. As illustrated in FIG. 10, a field-emission type cold cathode made in accordance with the present invention may include a plurality of emitter electrodes.

The complementariness in shape between the gate feeder line 9 and the focusing electrode 3 is not to be limited to that in the first embodiment as illustrated in FIG. 7A. For instance, as illustrated in FIG. 10, the complementariness may be defined so that the feeder line 9 and the focusing electrode 3 include two C-shaped portions 20. As an alternative, the complementariness may be defined so that there are three or more C-shaped portions 20.

In essence, the complementariness in shape between the feeder line and the focusing electrode may be comprised of linear segments, curved-line segments, or a combination of linear and curved-line segments. Specific examples of the complementariness are depicted in FIGS. 11A to 11C.

Figure 11A:
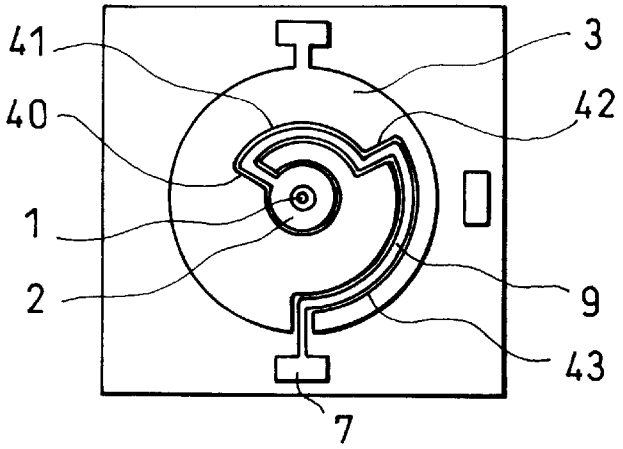
FIGS. 11A, 11B and 11C are plan views illustrating other variations of a field-emission type cold cathode made in accordance with the first embodiment.

As illustrated in FIG. 11A, the complementariness in shape between the gate feeder line 9 and the focusing electrode 3 may be comprised of a radially extending first linear segment 40, a circumferentially extending first arcuate segment 41 having about 120 degrees apex angle, a radially, outwardly extending second liner segment 42 making about 120 degrees angle with the first linear segment 40, and a circumferentially extending second arcuate segment 43 having about 120 degrees apex angle and reaching the gate pad 7. As an alternative, as illustrated in FIG. 11B, the complementariness in shape between the gate feeder line 9 and the focusing electrode 3 may be comprised of a radially extending linear segment 44 and a circumferentially extending arcuate segment 45 having about 180 degrees apex angle and reaching the gate pad 7. The complementariness in shape between the gate feeder line 9 and the focusing electrode 3 may be comprised of a horizontally, radially extending linear segment 46 and a linear segment 47 making an angle with the linear segment 46 and reaching the gate pad 7, as illustrated in FIG. 11C.

Figure 11B:
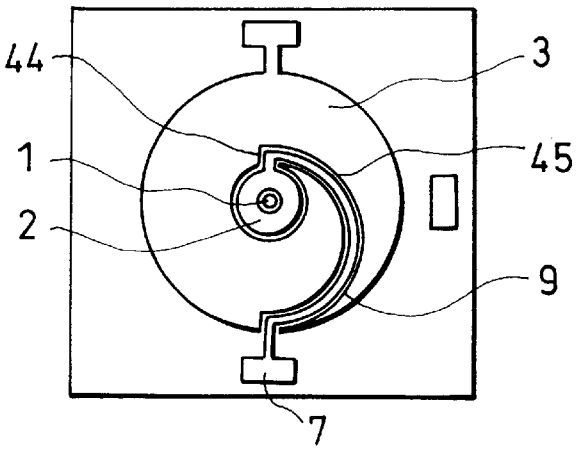
Figure 11C:
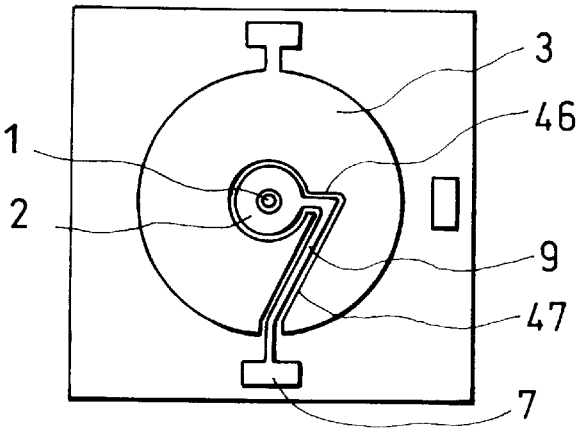

The complementariness in shape between the gate feeder line 9 and the focusing electrode 3 is not to be limited those depicted in FIGS. 11A to 11C, but may be defined in any shape unless the complementariness ensures that the focusing electrode 3 exists in all radial directions around the emitter electrode 1.

Figure 12A:
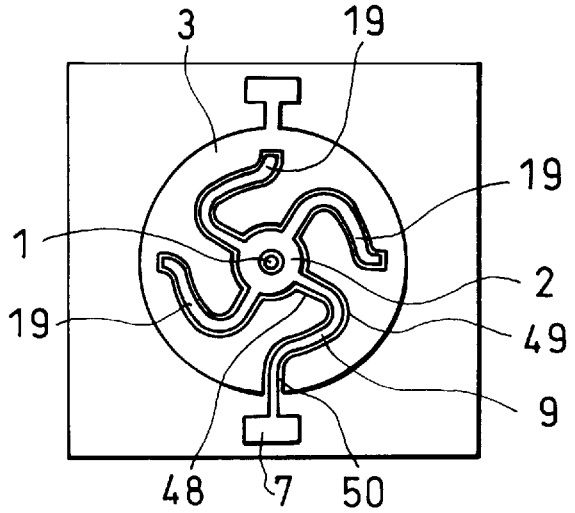
FIG. 12A is a plan view illustrating a field-emission type cold cathode made in accordance with the second embodiment of the present invention.

FIG. 12A illustrates a field-emission type cold cathode made in accordance with the second embodiment of the present invention. Elements corresponding to those of the first embodiment have been provided with the same reference numerals. The second embodiment is different from the first embodiment in that the second embodiment is further provided with compensation patterns.

As illustrated in FIG. 12A, the complementariness in shape between the gate feeder line 9 and the focusing electrode 3 is comprised of a first linear segment 48 radially extending from the gate electrode 2, a circumferentially extending arcuate segment 49, and a radially extending second linear segment 50 reaching the gate pad 7. The illustrated cold cathode is further provided with three compensation patterns 19 extending from the gate electrode 2. Each of the compensation patterns 19 has almost the same shape as the feeder line 9. More specifically, each of the compensation patterns 19 is comprised of the first linear segment 48 radially extending from the gate electrode 2, the circumferentially extending arcuate segment 49, and a radially extending second linear segment 50. The compensation patterns 19 and the gate feeder line 9 are disposed in rotational symmetry with one another. As a result, the gate feeder line 9 and the compensation patterns 19 cooperate with one another to form a windmill shape.

Figure 12B:
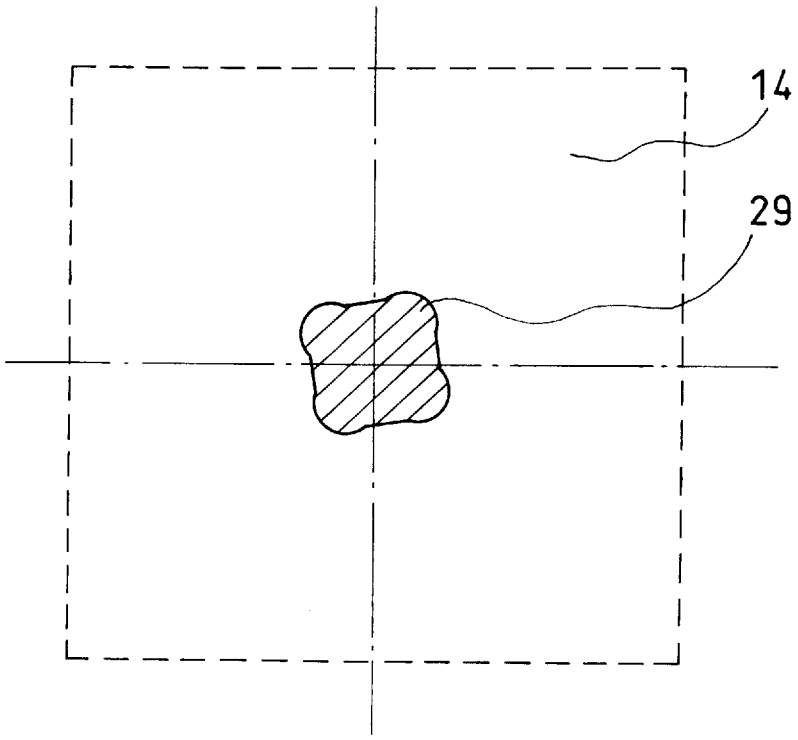
FIG. 12B shows emission area established when electron beams are emitted from an emitter electrode of the field-emission type cold cathode illustrated in FIG. 12A onto a fluorescent film.

The addition of the compensation patterns 19 diminishes the asymmetry in an electric field for focusing electron beams which could not be removed by the complementariness in shape between the gate feeder line 9 and the focusing electrode 3. As a result, an emission area 29 established on the fluorescent film 14 by the cathode illustrated in FIG. 12A is improved with respect to axis-symmetry, as illustrated in FIG. 12B, which in turn ensures that axis-symmetry in electron beams is further improved.

Though the above mentioned second embodiment includes only one emitter electrode 1, the number of the emitter electrodes is not to so limited to. Similarly to the first embodiment, a field-emission type cold cathode made in accordance with the second embodiment may include a plurality of emitter electrodes.

In addition, the number of the compensation patterns is not to be limited to three as exemplified in the second embodiment illustrated in FIG. 12A. Any number of compensation patterns may be formed if those compensation patterns and a gate feeder line are disposed in rotational symmetry with one another.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A field-emission type cold cathode comprising:

a substrate including at least one surface having electrical conductivity;

an insulating layer formed on said substrate;

an electrically conductive gate electrode formed on said insulating layer;

a conically shaped emitter electrode disposed in a hole formed through said gate electrode and said insulating layer;

a focusing electrode formed on said insulating layer, said focusing electrode being located in the same plane as said gate electrode and surrounding said gate electrode; and a feeder line formed in the same plane as said gate electrode, said feeder line extending from said gate electrode into said focusing electrode and being shaped complementarily with said focusing electrode so that said focusing electrode is present at every radial direction around a center of said emitter electrode.

2. The field-emission type cold cathode as set forth in claim 1, wherein complementariness in shape between said feeder line and said focusing electrode is comprised of linear segments.

3. A field-emission type cold cathode as set forth in claim 2, wherein said complementariness includes at least one C-shaped portion.

4. The field-emission type cold cathode as set forth in claim 2, wherein said complementariness includes at least one line making an angle with a radius of said gate electrode.

5. The field-emission type cold cathode as set forth in claim 1, wherein complementariness in shape between said feeder line and said focusing electrode is comprised of curved-line segments.

6. The field-emission type cold cathode as set forth in claim 1, wherein complementariness in shape between said feeder line and said focusing electrode is comprised of a combination of linear and curved-line segments.

7. The field-emission type cold cathode as set forth in claim 6, wherein said complementariness is comprised of a combination of radially extending lines and lines circumferentially extending around said emitter electrode.

8. A field-emission type cold cathode comprising:

a substrate including at least one surface having electrical conductivity;

an insulating layer formed on said substrate;

an electrically conductive gate electrode formed on said insulating layer;

a conically shaped emitter electrode disposed in a hole formed through said gate electrode and insulating layer;

a focusing electrode formed on said insulating layer, said focusing electrode being located in the same plane as said gate electrode and surrounding said gate electrode;

a feeder line formed in the same plane as said gate electrode, said feeder line extending from said gate electrode into said focusing electrode and being shaped complementarily with said focusing electrode so that said focusing electrode is present at every radial direction around a center of said emitter electrode; and at least one compensation pattern formed with said gate electrode, said compensation pattern being disposed in rotational symmetry with a part of said feeder line.

9. The field-emission type cold cathode as set forth in claim 8, wherein complementariness in shape between said feeder line and said focusing electrode is comprised of linear segments.

10. The field-emission type cold cathode as set forth in claim 9, wherein said complementariness includes at least one C-shaped portion.

11. The field-emission type cold cathode as set forth in claim 9, wherein said complementariness includes at least one lines making an angle with a radius of said gate electrode.

12. The field-emission type cold cathode as set forth in claim 8, wherein complementariness in shape between said feeder line and said focusing electrode is comprised of curved-line segments.

13. The field-emission type cold cathode as set forth in claim 8, wherein complementariness in shape between said feeder line and said focusing electrode is comprised of a combination of linear and curved-line segments.

14. The field-emission type cold cathode as set forth in claim 13, wherein said complementariness is comprised of a combination of radially extending lines and lines circumferentially extending around said emitter electrode.

15. The field-emission type cold cathode as set forth in claim 8, wherein said feeder line and said compensation pattern cooperate with each other to form a windmill shape.

* * * * *